US011684235B2

(12) United States Patent
Tan et al.

(10) Patent No.: US 11,684,235 B2
(45) Date of Patent: Jun. 27, 2023

(54) AIR EXHAUSTING DEVICE FOR KITCHENWARE, DISHWASHER, AND KITCHENWARE

(71) Applicants: Gree Electric Appliances (Wuhan) Co., Ltd, Hubei (CN); Gree Electric Appliances, Inc. of Zhuhai, Guangdong (CN)

(72) Inventors: Yibin Tan, Guangdong (CN); Shuguang Li, Guangdong (CN); Chunhong Li, Guangdong (CN); Yao Liu, Guangdong (CN); Min Yi, Guangdong (CN); Pu Zhang, Guangdong (CN); Qiwen Yang, Guangdong (CN); Shuai Shan, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 139 days.

(21) Appl. No.: 16/605,151

(22) PCT Filed: Dec. 25, 2017

(86) PCT No.: PCT/CN2017/118340
§ 371 (c)(1),
(2) Date: Oct. 14, 2019

(87) PCT Pub. No.: WO2018/233262
PCT Pub. Date: Dec. 27, 2018

(65) Prior Publication Data

US 2021/0100424 A1 Apr. 8, 2021

(30) Foreign Application Priority Data

Jun. 23, 2017 (CN) ..... 201710485888.6

(51) Int. Cl.
*A47L 15/48* (2006.01)
*F24C 15/20* (2006.01)

(52) U.S. Cl.
CPC ..... *A47L 15/488* (2013.01); *A47L 15/486* (2013.01)

(58) Field of Classification Search
CPC ..... A47L 15/488; A47L 15/486; F16L 9/22; F16L 25/10; F16L 37/505; F24C 15/2042;
(Continued)

(56) References Cited

U.S. PATENT DOCUMENTS 5,167,248 A 12/1992 Tuller
7,240,930 B2 * 7/2007 Stravitz ..... D06F 58/20 285/903
(Continued)

FOREIGN PATENT DOCUMENTS

CN 202973451 U 6/2013
CN 204581198 U 8/2015
(Continued)

OTHER PUBLICATIONS

International Search Report, dated Apr. 2, 2018, in International application No. PCT/CN2017/118340, filed on Dec. 25, 2017.
(Continued)

*Primary Examiner* — Joseph L. Perrin
*Assistant Examiner* — Irina Graf
(74) *Attorney, Agent, or Firm* — McAndrews, Held & Malloy, Ltd.

(57) ABSTRACT

Provided are an air exhausting device for kitchenware, a dishwasher, and kitchenware. The air exhausting device for kitchenware includes: an air duct including an air outlet end and a first connecting portion disposed on the air outlet end; and an air outlet member including an air inlet end and a second connecting portion provided on the air inlet end, and
(Continued)

an air outlet end of the air outlet member being provided with an air outlet port. The first connecting portion is slidably coupled to the second connecting portion for adjusting a relative position of the air outlet port and the air duct.

14 Claims, 8 Drawing Sheets

(58) Field of Classification Search
CPC .. F24C 15/20; F24C 15/2092; F24C 15/2085; F24C 15/006; F24C 15/2078
See application file for complete search history.

(56) References Cited

U.S. PATENT DOCUMENTS

| | | | | |
|---|---|---|---|---|
| 7,798,157 | B2 * | 9/2010 | Kim | A47L 15/486 134/107 |
| 2005/0040648 | A1 * | 2/2005 | Smolenski | A47L 9/244 285/314 |
| 2007/0079823 | A1 * | 4/2007 | Shin | F24C 15/2085 126/299 D |
| 2007/0095369 | A1 * | 5/2007 | Wetzel | A47L 15/48 134/56 D |
| 2007/0251552 | A1 * | 11/2007 | Lee | A47L 15/4251 134/56 D |
| 2009/0056769 | A1 * | 3/2009 | Han | A47L 15/4257 134/182 |
| 2010/0083991 | A1 * | 4/2010 | Tolf | A47L 15/488 134/95.2 |
| 2012/0055519 | A1 * | 3/2012 | Hong | B01D 53/261 134/107 |
| 2013/0008474 | A1 * | 1/2013 | Thayyullathil | A47L 15/488 34/201 |
| 2014/0150286 | A1 | 6/2014 | Jadhav et al. | |

FOREIGN PATENT DOCUMENTS

| | | | | | |
|---|---|---|---|---|---|
| CN | 105796033 | A | | 7/2016 | |
| CN | 106562737 | A | | 4/2017 | |
| CN | 106839114 | A | | 6/2017 | |
| CN | 107348928 | A | | 11/2017 | |
| CN | 107449004 | A | * | 12/2017 | |
| CN | 207317181 | U | | 5/2018 | |
| CN | 207837506 | U | | 9/2018 | |
| EP | 1127532 | A2 | | 8/2001 | |
| JP | S-6184430 | U | * | 6/1986 | |
| KR | 20060031309 | A | | 4/2006 | |
| KR | 20080029523 | A | * | 4/2008 | F24F 7/04 |
| KR | 20080034233 | A | * | 4/2008 | |
| KR | 20150022437 | A | * | 3/2015 | A47L 15/14 |
| WO | WO-2009008828 | A1 | * | 1/2009 | A47L 15/4287 |

OTHER PUBLICATIONS

Chinese search report dated Oct. 10, 2018 in Chinese application No. 2017104858886 (2 pages).
Chinese search report dated May 20, 2019 in Chinese application No. 2017104858886 (2 pages).
The supplementary European search report for Application No. 17914230.2, dated Feb. 19, 2021, European Patent Office, Germany (9 pages).

* cited by examiner

AIR EXHAUSTING DEVICE FOR KITCHENWARE, DISHWASHER, AND KITCHENWARE

CROSS-REFERENCE TO RELATED APPLICATIONS

This application is a 371 of International Patent Application No. PCT/CN2017/118340, filed Dec. 25, 2017, entitled "Air Exhausting Device for Kitchenware, Dishwasher, and Kitchenware," which claims priority to Chinese Patent Application No. 201710485888.6 (application publication number CN107348928A), filed on Jun. 23, 2017, and entitled "Air Exhausting Device and Dishwasher with the Air Exhausting Device" contents of both of which are hereby incorporated by reference in their entirety.

TECHNICAL FIELD

Some embodiments of the present disclosure relates to an air exhausting device for kitchenware, a dishwasher, and kitchenware.

BACKGROUND

Tableware is usually required to be dried after being cleaned by a dishwasher. Some of existing dishwashers use waste heat to dry the tableware, and some of the existing dishwashers use an additional drying system to dry the tableware. The drying system may be an air exhausting device through which humid air inside the dishwasher is discharged to the outside for purposes for drying the dishwasher. An air outlet port of the air exhausting device is usually located at a lower end of a dishwasher door, and the height of the air outlet port is fixed. Users of semi-embedded and fully-embedded dishwashers may install a wooden board on the dishwasher according to the preference. But since the semi-embedded and fully-embedded dishwashers usually need to be installed in conjunction with cabinets, and the height of skirting boards of different cabinets is different, this air exhausting device with a height-fixed air outlet port is not suitable for installing different cabinets.

SUMMARY

Some embodiments of the present disclosure provide an air exhausting device with a position-adjustable air outlet port for kitchenware, a dishwasher, and kitchenware.

Some embodiments of the present disclosure provide an air exhausting device for kitchenware, which include: an air duct including an air outlet end and a first connecting portion disposed on the air outlet end; and an air outlet member including an air inlet end and a second connecting portion provided on the air inlet end, and an air outlet end of the air outlet member being provided with an air outlet port. The first connecting portion slidably coupled to the second connecting portion for adjusting a relative position of the air outlet port and the air duct.

In an exemplary embodiment, the first connecting portion and the second connecting portion are sleeved with each other.

In an exemplary embodiment, the air exhausting device for kitchenware includes a first limiting assembly arranged between the first connecting portion and the second connecting portion for preventing separation of the air outlet member from the air duct.

In an exemplary embodiment, the first limiting assembly includes: a first limiting protrusion arranged on one of the first connecting portion and the second connecting portion; and a limiting surface arranged on the other one of the first connecting portion and the second connecting portion. The limiting surface is cooperated with the first limiting protrusion to achieve preventing.

In an exemplary embodiment, the air exhausting device for kitchenware includes a sliding groove provided on one of the first connecting portion and the second connecting portion, wherein the sliding groove extends along a motion direction of the air outlet member relative to the air duct. An end portion of the sliding groove forms the limiting surface.

In an exemplary embodiment, the air exhausting device for kitchenware including a plurality of latching teeth disposed in the sliding groove, wherein each of the plurality of latching teeth is cooperated with the first limiting protrusion to limit the position of the air outlet member.

In an exemplary embodiment, the air exhausting device for kitchenware includes a guide assembly arranged between the first connecting portion and the second connecting portion, wherein the guide assembly is configured to guide a relative motion of the air outlet member and the air duct.

In an exemplary embodiment, the guide assembly includes: a guide protrusion arranged on one of the first connecting portion and the second connecting portion; and a guide groove provided on the other one of the first connecting portion and the second connecting portion. The guide protrusion is slidably coupled to the guide groove.

In an exemplary embodiment, the guide protrusion is arranged on the second connecting portion and protrudes toward an inner side of the air outlet member. The guide groove is provided on the first connecting portion.

In an exemplary embodiment, the air outlet member includes an air guide portion, wherein the air outlet port is provided on the air guide portion, and the air guide portion is configured to guide air from the air outlet member to an outside of the kitchenware.

Some embodiments of the present disclosure also provide a dishwasher, which includes the aforementioned air exhausting device for kitchenware.

In an exemplary embodiment, the dishwasher includes a door for opening and closing the dishwasher and a decorative panel; wherein the air exhausting device is arranged between the decorative panel and the door, and the air guide portion is located below the decorative panel and extended to an outside of the dishwasher.

In an exemplary embodiment, the dishwasher includes: a second limiting assembly arranged between the air outlet member and the decorative panel for limiting a position of the air outlet member.

In an exemplary embodiment, the second limiting assembly includes: a limiting member arranged on one of the decorative panel and the air outlet member; and a second limiting protrusion arranged on the other one of the decorative panel and the air outlet member. The limiting member is cooperated with the second limiting protrusion to limit the position of the air outlet member.

In an exemplary embodiment, the limiting member is arranged on the decorative panel, and the limiting member includes: a first limiting plate arranged on the decorative panel; and a second limiting plate arranged on the first limiting plate and extended toward the air outlet member. The second limiting plate is configured to support the second limiting protrusion.

In an exemplary embodiment, the limiting member includes a third limiting protrusion arranged on the second limiting plate. A space for accommodating the second limiting protrusion is formed between the third limiting protrusion and the first limiting plate.

Some embodiments of the present disclosure also provide kitchenware, which includes a cabinet and the aforementioned dishwasher. The dishwasher is embedded into the cabinet wholly or partially.

The air exhausting device provided by the present disclosure has a position-adjustable air outlet member, and is suitable for cabinets of different structures, which is advantageous for realizing the versatility of materials of a same platform, also better integrating the air exhausting device and the cabinet, and improving the overall attractiveness.

Other features of the present disclosure and its advantages will be apparent from the following detailed description of exemplary embodiments of the present disclosure with reference to the following drawings.

BRIEF DESCRIPTION OF THE DRAWINGS

The accompanying drawings described herein are used to provide a further understanding of the present disclosure, and constitute a part of the present application, and the exemplary embodiments of the present disclosure and the description thereof are used to explain the present disclosure, but do not constitute improper limitations to the present disclosure. In the drawings.

REFERENCE NUMERALS IN THE DRAWINGS

Figure 1:
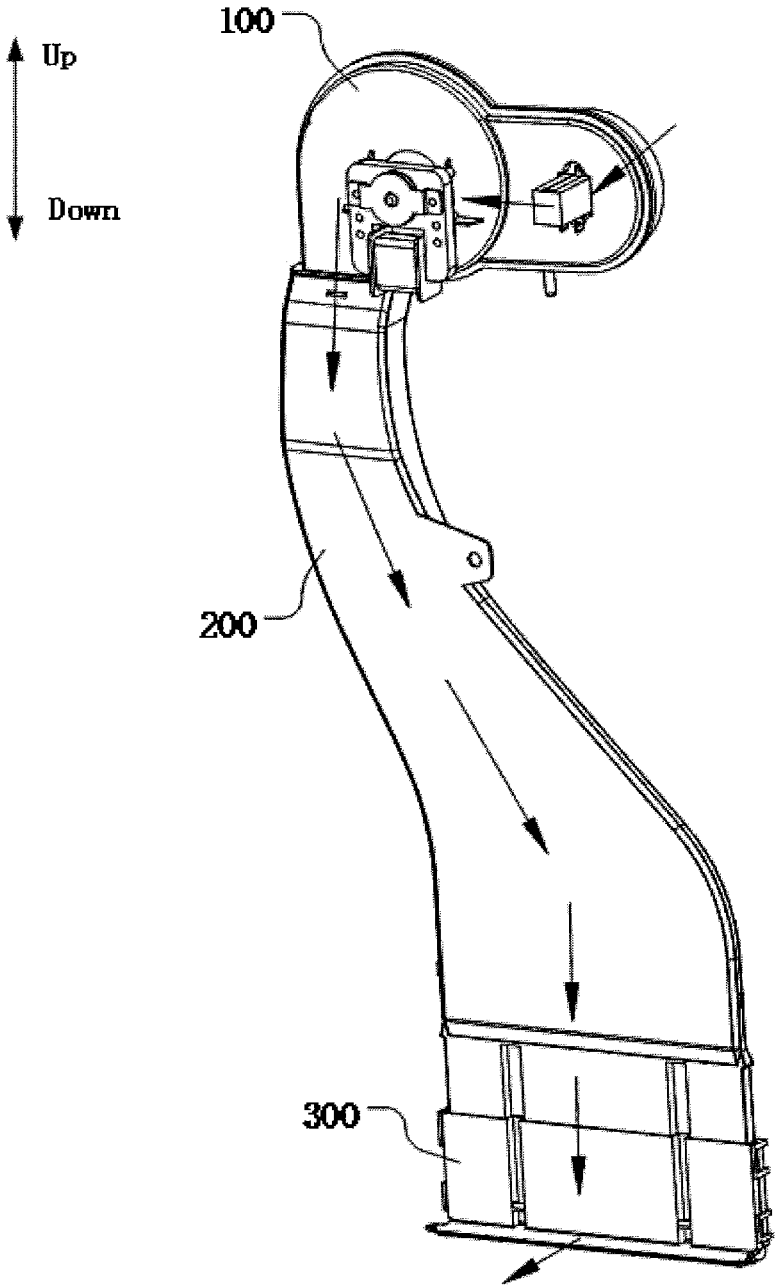
FIG. 1 illustrates a structure diagram of an air exhausting device for kitchenware according to one or more embodiments of the present disclosure.

100: fan assembly; 110: volute; 111: volute outlet; 120: fan; 130: motor;

200: air duct; 210: air inlet end; 220: first connecting portion; 221: first limiting protrusion; 222: guide groove; 223: limiting surface;

300: air outlet member; 301: second connecting portion; 302: air guide portion; 310: first portion; 311: clamping block; 312: first sliding groove; 3121: latching tooth; 313: guide protrusion; 314: first air guide portion; 3141: fixing hole; 315: second limiting protrusion; 320: second portion; 321: clamping ring; 322: second sliding groove; 324: second air guide portion;

400: decorative panel; 410: limiting member; 411: first limiting plate; 412: second limiting plate; 413: third limiting protrusion; 414: positioning portion;

500: dishwasher; 510: door.

DETAILED DESCRIPTION OF THE EMBODIMENTS

The technical solutions in the embodiments of the present disclosure are clearly and completely described in the following with reference to the accompanying drawings in the embodiments of the present disclosure. It is apparent that the described embodiments are merely a part of the embodiments of the present disclosure, but not all of the embodiments. The following description of at least one exemplary embodiment is only illustrative actually, and is not used as any limitation for the present disclosure and the application or use thereof. On the basis of the embodiments of the present disclosure, all other embodiments obtained on the premise of no creative work of those of ordinary skill in the art fall within the scope of protection of the present disclosure.

Unless otherwise specified, relative arrangements of assemblies and steps elaborated in these embodiments, numeric expressions and numeric values do not limit the scope of the present disclosure. Furthermore, it should be understood that for ease of descriptions, the size of each part shown in the drawings is not drawn in accordance with an actual proportional relation. Technologies, methods and devices known by those skilled in the related art may not be discussed in detail. However, where appropriate, the technologies, the methods and the devices shall be regarded as part of the authorized description. In all examples shown and discussed herein, any specific values shall be interpreted as only exemplar values instead of limited values. As a result, other examples of the exemplar embodiments may have different values. It is to be noted that similar marks and letters represent similar items in the following drawings. As a result, once a certain item is defined in one drawing, it is unnecessary to further discus the certain item in the subsequent drawings.

Note: "Up" and "down" mentioned in this paper are up and down marked in FIG. 1, that is, up and down when an air exhausting device is in working condition.

An air exhausting device for kitchenware provided by the present disclosure can be used for a dishwasher, in particular an embedded dishwasher, by which high-humidity air in the dishwasher is discharged to achieve the effect of drying tableware inside the dishwasher. Moreover, the air exhausting device provided by the present disclosure is applicable to different cabinets by providing a height-adjustable air outlet member.

Figure 2:
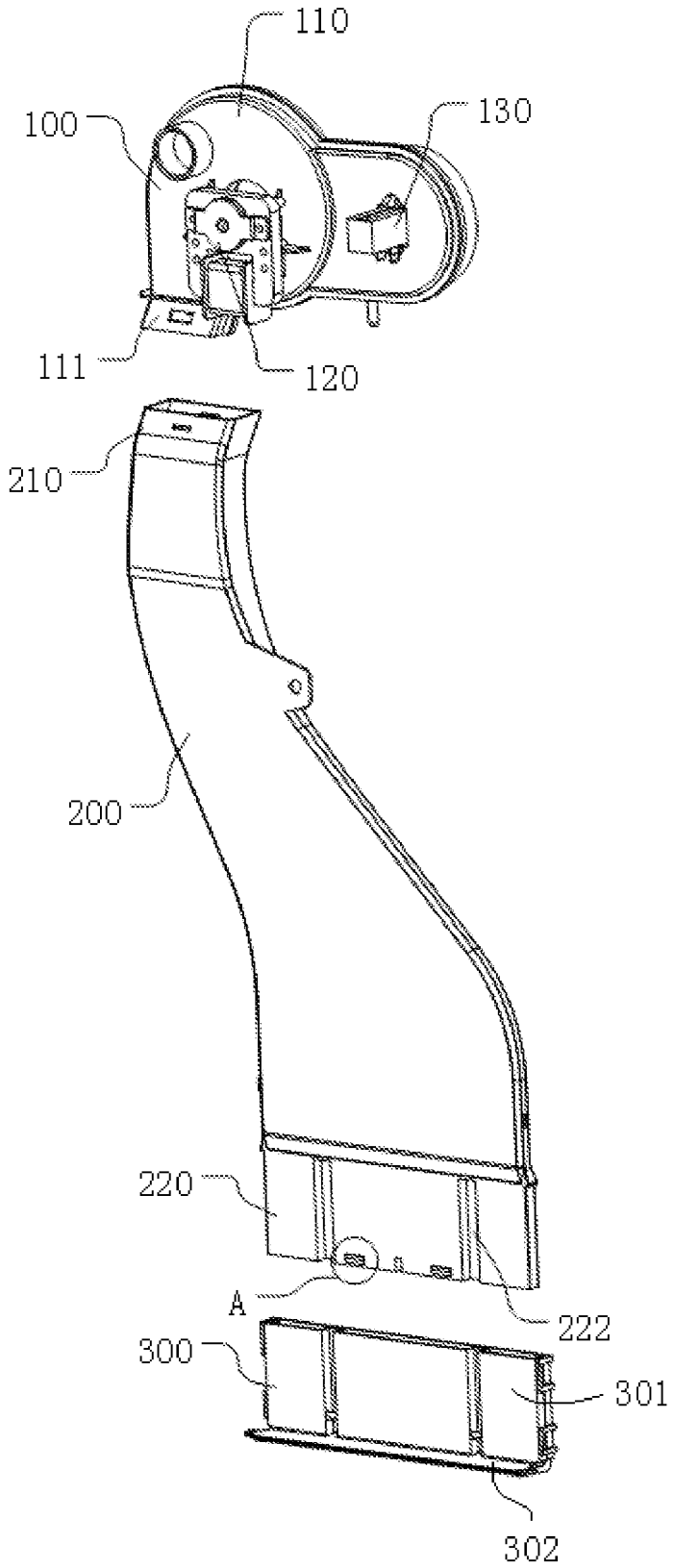
FIG. 2 illustrates an exploded diagram of an air exhausting device for kitchenware according to one or more embodiments of the present disclosure.

As shown in FIG. 1 and FIG. 2, an air exhausting device for kitchenware according to one or more embodiments is illustrated.

In some embodiments, the air exhausting device includes a fan assembly 100, an outlet of the fan assembly 100 is connected to an air inlet end of an air duct 200.

In some embodiments, the air exhausting device includes an air duct 200, an air outlet end of the air duct 200 is provided with a first connecting portion 220.

In some embodiments, the air exhausting device includes an air outlet member 300, an air inlet end of the air outlet member 300 is provided with a second connecting portion 301, and an air outlet end of the air outlet member 300 is provided with an air outlet port.

In some embodiments, the first connecting portion 220 is slidably coupled to the second connecting portion 301 for adjusting a relative position of the air outlet port and the air duct 200.

In at least one embodiment, the air outlet member 300 is slidably coupled to the air duct 200, and at least a part of the air outlet member 300 may communicate with the air duct 200.

In some embodiments, the first connecting portion 220 and the second connecting portion 301 are sleeved with each other. In an exemplary embodiment, the first connecting portion 220 is arranged in the second connecting portion 301.

In some embodiments, the air exhausting device for kitchenware includes a first limiting assembly arranged between the first connecting portion 220 and the second connecting portion 301 for preventing separation of the air outlet member 300 from the air duct 200. That is, a limit position at which the air outlet member 300 slides away from the air duct 200 is defined.

In some embodiments, the first limiting assembly includes a first limiting protrusion 221 and a limiting surface 223.

Figure 3:
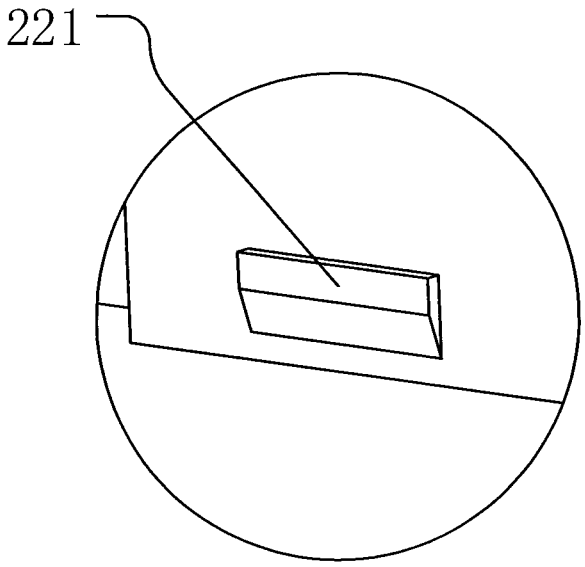
FIG. 3 illustrates an enlarged diagram of part A in FIG. 2.

The first limiting protrusion 221 is arranged on one of the first connecting portion 220 and the second connecting portion 301, as shown in FIG. 3.

The limiting surface 223 is arranged on the other one of the first connecting portion 220 and the second connecting portion 301.

The limiting surface 223 is used to cooperate with the first limiting protrusion 221 to achieve preventing.

In an exemplary embodiment, the first limiting assembly includes a first limiting protrusion 221 arranged on at least one outer wall of the first connecting portion 220, and further includes a limiting surface 223 arranged inside the air outlet member 300. The first limiting protrusion 221 abuts against the limiting surface 223 to prevent the first limiting protrusion 221 from slipping.

In some embodiments, the air exhausting device for kitchenware includes a sliding groove 312, 322 provided on one of the first connecting portion 220 and the second connecting portion 301, wherein the sliding groove 312, 322 extends along a motion direction of the air outlet member 300 relative to the air duct 200, an end portion of the sliding groove 312, 322 forms the limiting surface 223.

Figure 4:
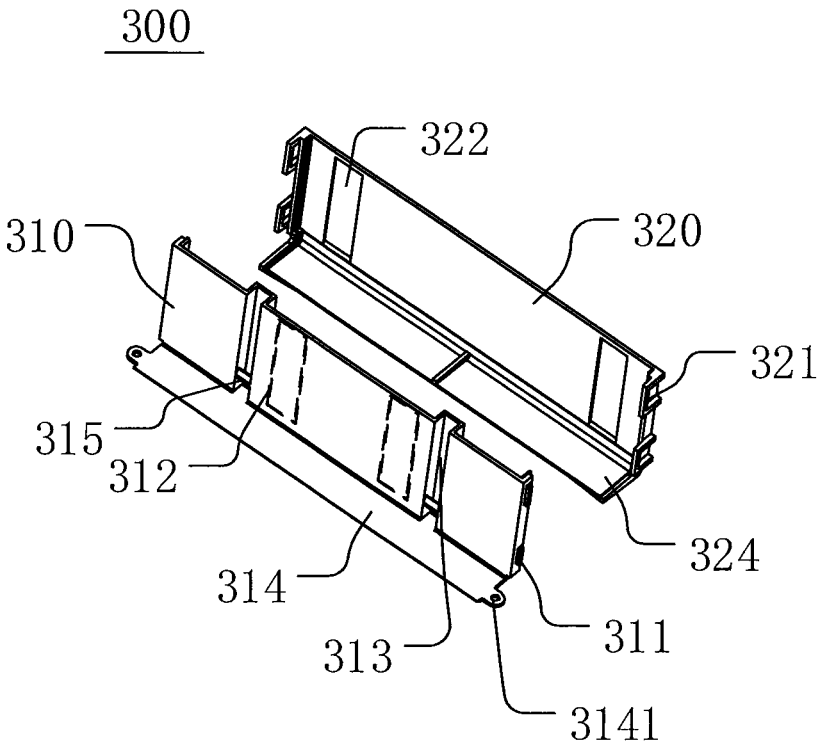
FIG. 4 illustrates a diagram of an air outlet member according to one or more embodiments of the present disclosure.

As shown in FIG. 4, in an exemplary embodiment, the air outlet member 300 includes a first portion 310 and a second portion 320. The first portion 310 and the second portion 320 are combined to form a housing. One end of the housing forms an air inlet port, and the other end forms an air outlet port.

In an exemplary embodiment, the sliding groove 312, 322 includes at least one of a first sliding groove 312 provided on the first portion 310, and/or a second sliding groove 322 provided on the second portion 320.

Figure 5:
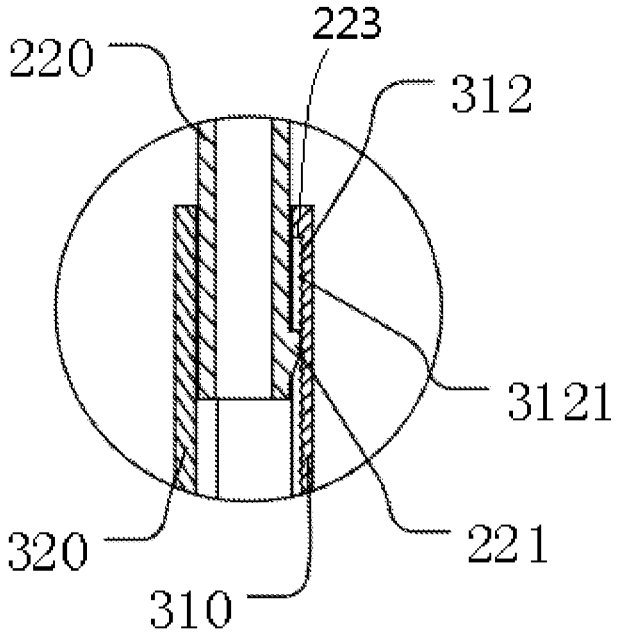
FIG. 5 illustrates a partial sectional diagram of an air outlet member including latching teeth cooperating with a limiting protrusion according to one or more embodiments of the present disclosure.

As shown in FIG. 5, in some embodiments, the air exhausting device for kitchenware including a plurality of latching teeth 3121 disposed in the sliding groove 312, 322, wherein each of the plurality of latching teeth 3121 is cooperated with the first limiting protrusion 221 to limit a position of the air outlet member 300.

In some embodiments, the air exhausting device for kitchenware includes a guide assembly arranged between the first connecting portion 220 and the second connecting portion 301, wherein the guide assembly is configured to guide a relative motion of the air outlet member 300 and the air duct 200.

In some embodiments, the guide assembly includes a guide protrusion 313 and a guide groove 222.

The guide protrusion 313 is arranged on one of the first connecting portion 220 and the second connecting portion 301.

The guide groove 222 is provided on the other one of the first connecting portion 220 and the second connecting portion 301.

The guide protrusion 313 is slidably coupled to the guide groove 222.

In some embodiments, the guide protrusion 313 is arranged on the second connecting portion 301, and protrudes toward an inner side of the air outlet member 300. The guide groove 222 is provided on the first connecting portion 220.

In an exemplary embodiment, a guide protrusion 313 is arranged on the first portion 310 and/or the second portion 320 of the air outlet member 300, the guide protrusion 313 extends in a relative sliding direction of the air outlet member 300 relative to the air duct 200, and the first connecting portion 310 is provided with a guide groove 222 adaptive to the guide protrusion 313.

In some embodiments, the air outlet member 300 includes an air guide portion 302, the air outlet port of the air outlet member 300 is provided on the air guide portion 302, and the air guide portion 302 is configured to guide air from the air outlet member 300 to an outside of the kitchenware.

Figure 10:
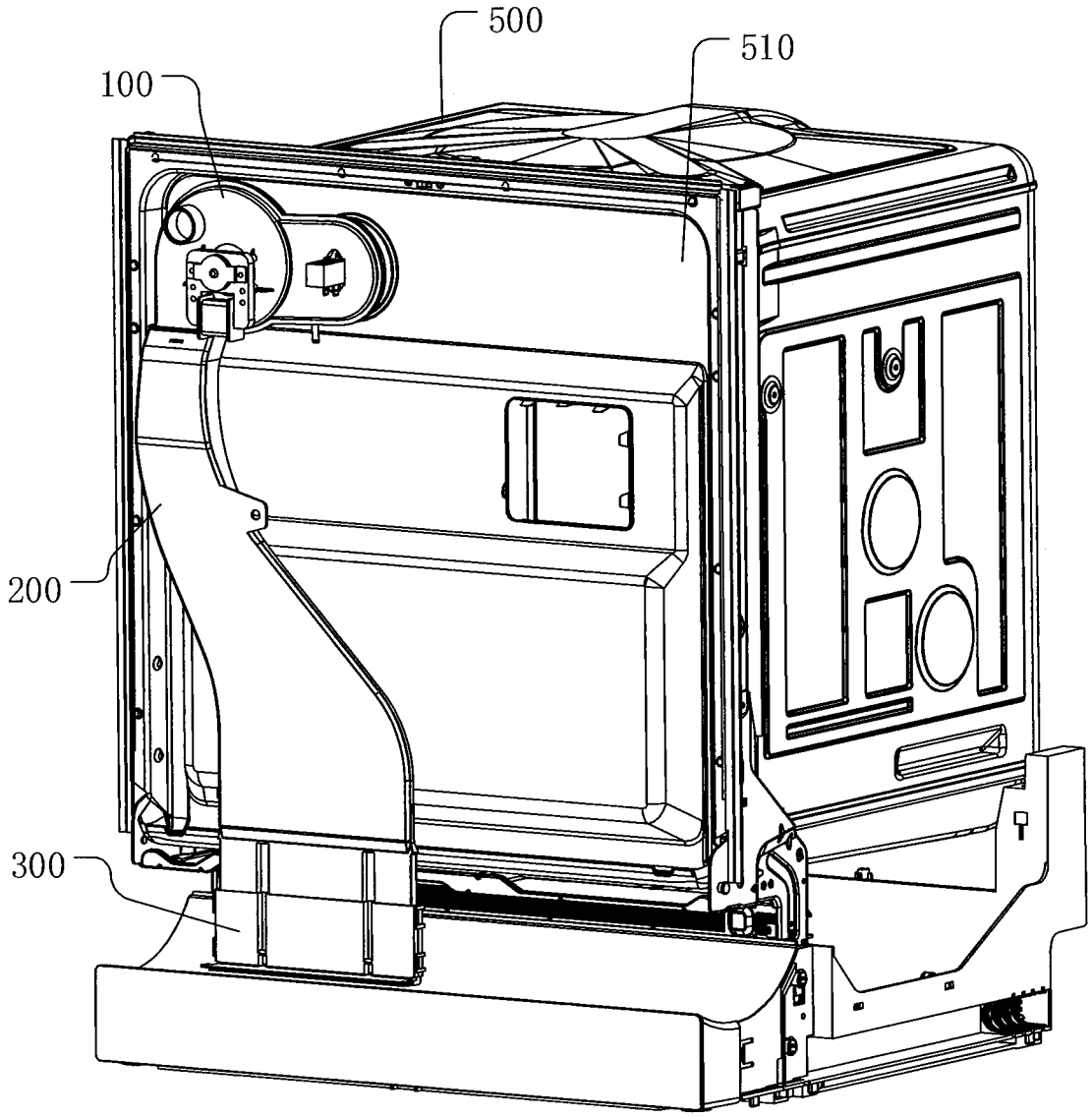
FIG. 10 illustrates a structure diagram of a dishwasher according to one or more embodiments of the present disclosure.

As shown in FIG. 10, a dishwasher according to one or more embodiments is illustrated.

In some embodiments, the dishwasher includes the aforementioned air exhausting device for kitchenware.

In some embodiments, the dishwasher includes a door 510 and a decorative panel 400.

The door 510 is configured to open and close the dishwasher.

Figure 6:
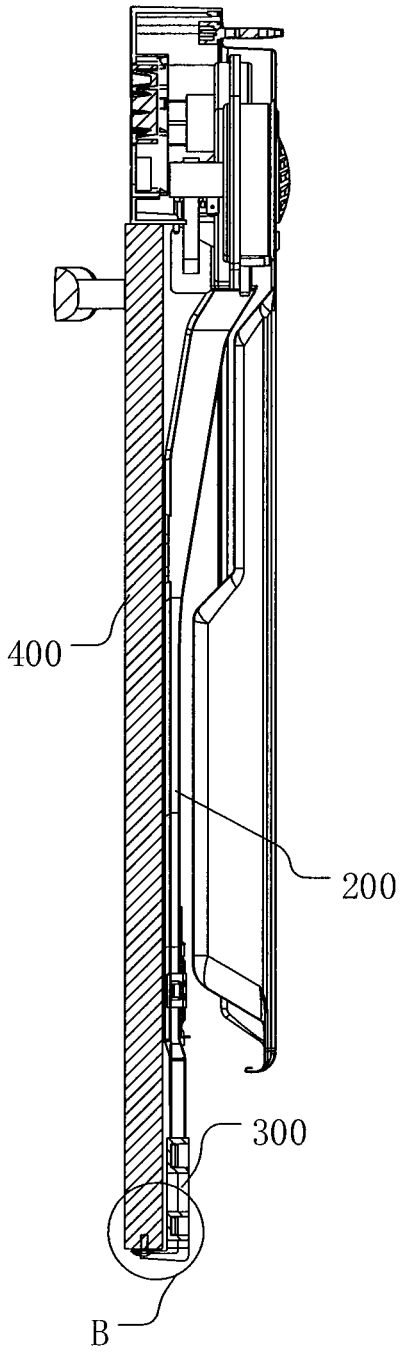
FIG. 6 illustrates a partial sectional structure diagram of installing an air exhausting device and a decorative panel according to one or more embodiments of the present disclosure.

The decorative panel 400 is as shown in FIG. 6.

Figure 7:
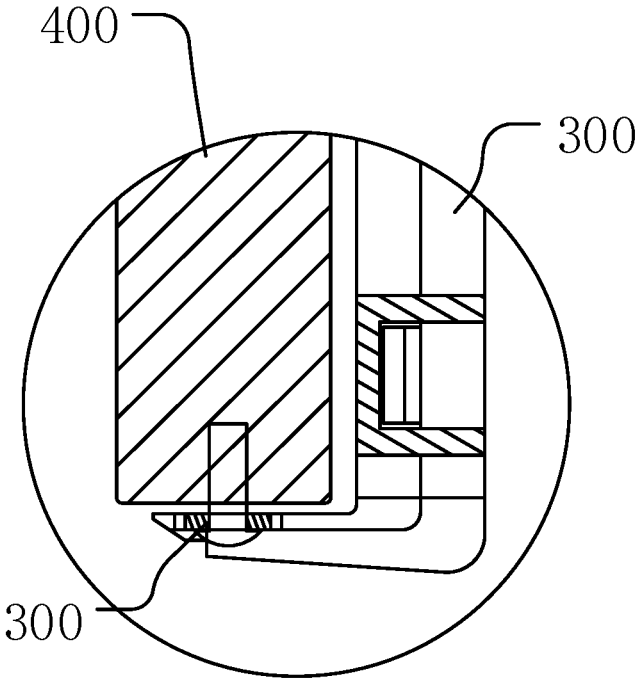
FIG. 7 illustrates an enlarged diagram of part B in FIG. 6.

The air exhausting device is arranged between the decorative panel 400 and the door 510, and the air guide portion 302 is located below the decorative panel 400 and extends to the outside of the dishwasher (as shown in FIG. 7).

In an exemplary embodiment, the air outlet member 300 is fixed to the decorative panel 400 (as shown in FIG. 7) by an adhesive or a fastener.

In some embodiments, the dishwasher includes a second limiting assembly arranged between the air outlet member 300 and the decorative panel 400 for limiting a position of the air outlet member 300.

Figure 8:
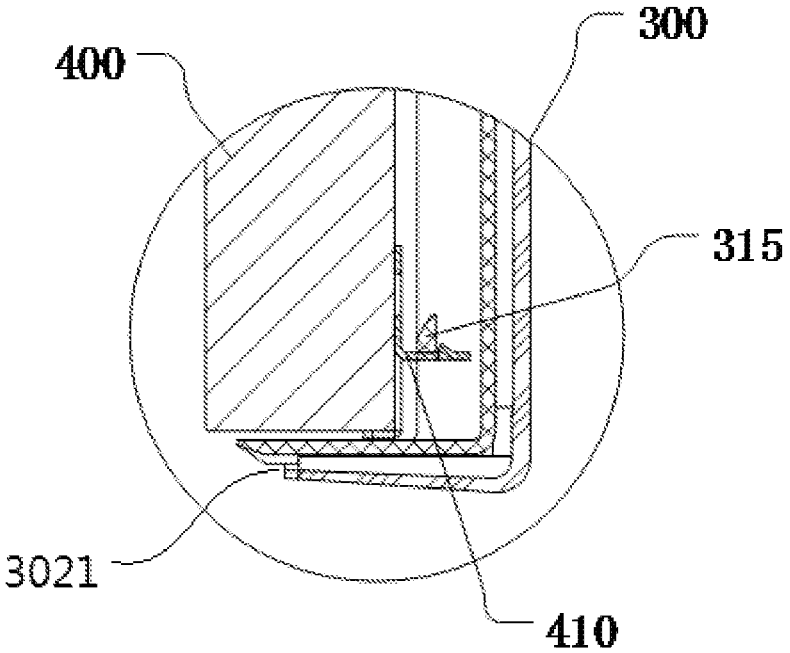
FIG. 8 illustrates a sectional diagram of providing a limiting member on a decorative panel to limit an air outlet member according to one or more embodiments of the present disclosure.

In some embodiments, as shown in FIG. 8, the second limiting assembly includes a limiting member 410 and a second limiting protrusion 315.

The limiting member 410 is arranged on one of the decorative panel 400 and the air outlet member 300.

The second limiting protrusion 315 is arranged on the other one of the decorative panel 400 and the air outlet member 300.

The limiting member 410 is cooperated with the second limiting protrusion 315 to limit the position of the air outlet member 300.

Figure 9:
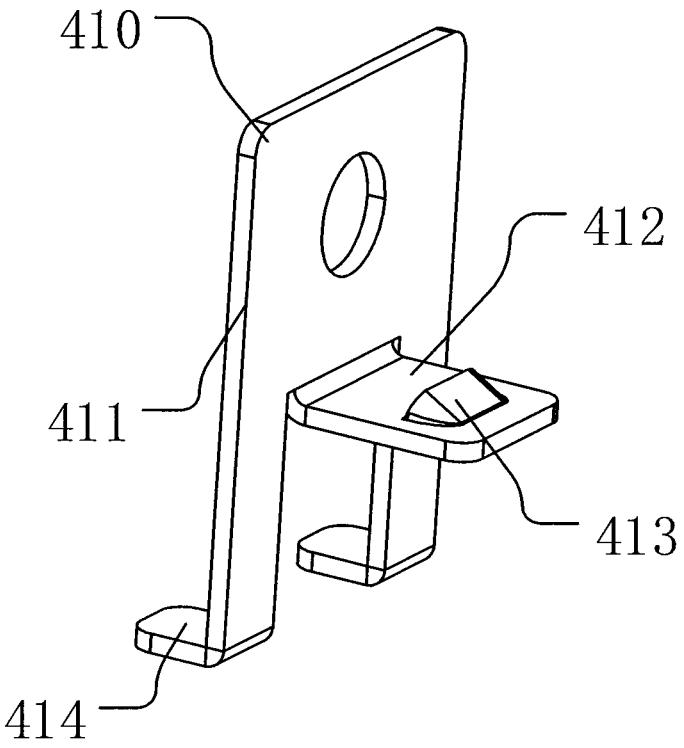
FIG. 9 illustrates a structure diagram of a limiting member according to one or more embodiments of the present disclosure.

In some embodiments, the limiting member 410 is arranged on the decorative panel 400. As shown in FIG. 9, the limiting member 410 includes a first limiting plate 411 and a second limiting plate 412.

The first limiting plate 411 is arranged on the decorative panel 400.

The second limiting plate 412 is arranged on the first limiting plate 411 and extended toward the air outlet member 300.

The second limiting plate 412 is configured to support the second limiting protrusion 315.

In some embodiments, as shown in FIG. 9, the limiting member 410 includes a third limiting protrusion 413 arranged on the second limiting plate 412. A space for accommodating the second limiting protrusion 315 is formed between the third limiting protrusion 413 and the first limiting plate 411.

Some embodiments of the present disclosure provided kitchenware, the kitchenware includes a cabinet and the aforementioned dishwasher. The dishwasher is embedded into the cabinet wholly or partially.

FIGS. 1-10 of the present disclosure will be described below in conjunction with specific embodiments.

As shown in FIGS. 1 and 2, the air exhausting device includes a fan assembly 100, an air duct 200 and an air outlet member 300. The flow direction of air in the air exhausting device is as indicated by an arrow in FIG. 1.

The fan assembly 100 includes a volute 110, a fan 120 arranged on the volute 110, and a motor 130 arranged at an inlet of the volute 110. The motor 130 controls opening and closing of the inlet of the volute 110. Under the action of the fan 120, air enters the volute 110 from the inlet of the volute 110 and is discharged from a volute outlet 111.

The air duct 200 includes an air inlet end 210 and a first connecting portion 220. The air inlet end 210 is connected to the volute outlet 111 of the volute 110, and air discharged from the volute 110 enters the air duct 200.

In an exemplary embodiment, the air inlet end 210 and the volute outlet 111 are fixedly connected by a buckle or a bolt, etc. In the present embodiment, they are connected by a buckle.

The air outlet member 300 is slidably coupled to the first connecting portion 220 with respect to the air duct 200 along the flow direction (e.g., up-down direction shown in FIG. 1) of the air inside the air duct 200.

A first limiting assembly is arranged between the first connecting portion 220 and the air outlet member 300, and the first limiting assembly is configured to limit a sliding limit position of the air outlet member 300 in a direction away from the air duct 200.

In an exemplary embodiment, the limiting assembly includes a first limiting protrusion 221 arranged on an outer wall of the first connecting portion 220, and a limiting surface 223 arranged on the air outlet member 300.

As shown in FIG. 3, the first limiting protrusion 221 is a protrusion arranged at a position close to a lower end edge of the first connecting portion 220. In an exemplary embodiment, an upper side surface of the first limiting protrusion 221 is a surface perpendicular to a side wall of the first connecting portion 220, and a lower side surface of the first limiting protrusion 221 is a inclined surface at an angle to the side wall of the first connecting portion 220. The upper side surface of the first limiting protrusion 221 is cooperated with the air outlet member 300 to prevent the air outlet member 300 from slipping off from the first connecting portion 220. The lower side surface of the first limiting protrusion 221 is set as the inclined surface to facilitate the installation of the air outlet member 300.

In an exemplary embodiment, two opposite side walls of the first connecting portion 220 are respectively provided with a first limiting protrusion 221.

As shown in FIG. 4, the air outlet member 300 includes a first portion 310 and a second portion 320. The first portion 310 and the second portion 320 are combined to form a housing. Both ends of the housing respectively are formed with an air inlet port and an air outlet port.

In an exemplary embodiment, an upper end of the housing is formed with an air inlet port, and a lower end is formed with an air outlet port. The air inlet port of the housing is provided on the first connecting portion 220 in a sleeving manner, and air enters the housing from the first connecting portion 220, and is discharged from the air outlet port at the lower end of the housing.

In an exemplary embodiment, the first portion 310 and the second portion 320 are connected by a buckle. Both sides of the first portion 310 are provided with clamping blocks 311. Correspondingly, corresponding positions on the second portion 320 are provided with snap ring 321. During installation, the clamping blocks 311 and the clamping rings 321 are clamped to combine the first portion 310 and the second portion 320 together. Alternatively, in other embodiments, the first portion 310 and the second portion 320 may also be integrally formed.

A sliding groove is provided on the inner side of the air outlet member 300 to cooperate with the first limiting protrusion 221 on the first connecting portion 220. The wall surface of the upper end of the sliding groove constitutes a limiting surface 223 that cooperates with the first limiting protrusion 221.

As shown in FIG. 4, a first sliding groove 312 and/or a second sliding groove 322 are provided on the first portion 310 and/or the second portion 320. The first sliding groove 312 and/or the second sliding groove 322 are grooves extending along the sliding direction of the air outlet member 300 relative to the air duct 200 on the inner side walls of the first portion 310 and/or the second portion 320. The upper side surface of the first limiting protrusion 221 on the first connecting portion 220 is cooperated with the upper end surface of the first sliding groove 312 and/or the second sliding groove 322 for limiting the downward sliding direction of the air outlet member 300. The air outlet member 300 is prevented from slipping off from the first connecting portion 220.

In an exemplary embodiment, the first limiting protrusion 221 and the sliding groove are cooperated to guide the sliding of the air outlet member 300.

In order to make the sliding of the air outlet member 300 smoother, in an exemplary embodiment, a guide assembly is further provided on the air outlet member 300 and the first connecting portion 220.

As shown in FIG. 2 and FIG. 4, the guide assembly includes a guide groove 222 provided on the first connecting portion 220. The guide groove 222 extends along the sliding direction of the air outlet member 300, and the guide groove 222 is provided on a side opposite to the first portion 310. The guide assembly further includes a guide protrusion 313 arranged on the first portion 310, and the guide protrusion 313 is a protrusion formed on the first portion 310 toward the inner side thereof. The guide protrusion 313 extends in the sliding direction of the air outlet member 300.

After the air outlet member 300 is installed, the guide protrusion 313 is located in the guide groove 222 and can slide in the guide groove 222.

In an exemplary embodiment, the guide protrusion 313 is formed to protrude inward on the side wall of the first portion 310, that is, a groove is formed at a position, opposite to the guide protrusion 313, of the outer side of the first portion 310.

In an exemplary embodiment, the lower end of the first portion 310 is provided with a first air guide portion 314, and the first air guide portion 314 is formed by bending of the first portion 310.

The lower end of the second portion 320 is provided with a second air guide portion 324, the second air guide portion 324 is adapted to the first air guide portion 314, and the second air guide portion 324 is formed by bending of the second portion 320.

After the first portion 310 is combined with the second portion 320, the first air guide portion 314 is located on the upper side of the second air guide portion 324, and an air exhaust outlet 3021 is formed between the first air guide portion 314 and the second air guide portion 324.

After the position of the air outlet assembly 300 on the first connecting portion 220 is adjusted, the positional change of the air outlet assembly 300 needs to be restricted. The positional change of the air outlet assembly 300 can be restricted by the following modes:

As shown in FIG. 5, a plurality of latching teeth 3121 are arranged in the first sliding groove 312 of the air outlet member 300, and each of the plurality of latching teeth 3121 is cooperated with the first limiting protrusion 221 to determine the position of a sliding assembly 300 in the sliding direction of the air outlet member 300.

In an exemplary embodiment, the latching teeth 3121 may be arranged in the first sliding groove 312 and/or the second sliding groove 322.

Alternatively, as shown in FIG. 6, in other embodiments, the air exhausting device is installed in a cabinet, the air duct 200 is arranged in parallel with a decorative panel 400 of the cabinet, and the air outlet member 300 is located at a lower end of the decorative panel 400.

The air outlet member 300 may be fixed in position by cooperation with the decorative panel 400, and the air outlet member 300 may be fixed to the decorative panel 400 adjacent thereto by, for example, pasting or fastening using a fastener such as a screw.

In an exemplary embodiment, as shown in FIGS. 4 and 7, a fixing hole 3141 is provided on the first air guide portion 314, and the first air guide portion 314 is fixed to a cabinet door 400 by screws, thereby fixing the position of the air outlet member 300. Alternatively, the first air guide portion 314 may be adhered and fixed to the cabinet door 400.

Or, as shown in FIGS. 4 and 8, a second limiting protrusion 315 is arranged on the first portion 310, a limiting member 410 is arranged on the decorative panel 400, and the limiting member 410 and the second limiting protrusion 315 are cooperated to determine the position of the air outlet member 300.

As shown in FIG. 9, the limiting member 410 includes a first limiting plate 411 and a second limiting plate 412. The second limiting plate 412 is arranged perpendicular to the first limiting plate 411, and the first limiting plate 411 is adhered and fixed to the cabinet door 400.

During installation, the second limiting plate 412 is located on the lower side of the second limiting protrusion 315 to support the second limiting protrusion 315 so as to define the position of the air outlet member 300.

In an exemplary embodiment, the second limiting protrusion 315 may be arranged in a groove formed by the guide protrusion 313, and the second limiting protrusion 315 is connected to two side walls of the groove, and is spaced apart from a bottom wall of the groove.

A third limiting protrusion 413 is arranged on the second limiting plate 412. During installation, the second limiting protrusion 315 is located between the first limiting plate 411 and the third limiting protrusion 413, the position of the second limiting protrusion 315 in the plane direction of the second limiting plate 412 is further defined.

In an exemplary embodiment, the limiting member 410 is further provided with a positioning portion 414. The positioning portion 414 is arranged at an end portion of the first limiting plate 411 and extends in a direction opposite to the extending direction of the second limiting plate 412.

The positioning portion 414 is configured to achieve positioning when the limiting member 410 is installed on the decorative panel 400 to install the limiting member 410 to the lower end of the decorative panel 400.

The decorative panel 400 described above may be a panel provided on the cabinet door of the dishwasher, or may be a panel on the cabinet.

Some embodiments of the present disclosure also provide a dishwasher. As shown in FIG. 10, the dishwasher 500 is provided with the aforementioned air exhausting device, and an inlet of the volute 110 of the air exhausting device is connected to an air exhaust outlet 3021 of the dishwasher 500. In an exemplary embodiment, the air exhausting device is arranged on a door 510 of the dishwasher 500, and humid air in the dishwasher 500 is discharged by the air exhausting device to achieve the effect of drying tableware in the dishwasher 500.

In an exemplary embodiment, the dishwasher 500 is an embedded dishwasher, the dishwasher 500 is embedded in the cabinet, and a decorative wood panel (decorative panel 400) is installed on the door 510 of the dishwasher 500 for aesthetic purposes, or a door panel of the cabinet is installed on the door 510 of the dishwasher 500.

At the time of installation, the decorative wood panel or the door panel of the cabinet is first installed on the door 510, and then a height of the air outlet member 300 is adjusted, so that the air outlet port of the air outlet member 300 is located at the lower end of the decorative wood panel or the door panel of the cabinet, the air outlet port faces an outer side of the decorative wood panel or the door panel of the cabinet, and finally the position of the air outlet member 300 is fixed.

In an exemplary embodiment, the position of the air outlet member 300 is fixed by connecting the air outlet member 300 to the decorative wood panel or the door panel of the cabinet. Alternatively, in other embodiments, other bodies of the cabinet may also be installed on the door 510, and the air outlet member 300 is fixed to other bodies of the cabinet.

The air exhausting device provided by the present disclosure is provided with the height-adjustable air outlet member 300, so that the dishwasher is applicable to different cabinets.

It will be readily understood by those skilled in the art that the above various preferred embodiments can be freely combined and superimposed without conflict.

In the description of the present disclosure, it is to be understood that terms "first", "second", "third" and the like are used to limit parts, and are only intended to distinguish the above parts. If there are no otherwise statements, the above terms do not have special meanings, such that they cannot be understood as limits to the scope of protection of the present disclosure.

Finally, it is to be noted that the above embodiments are only used to illustrate the technical solutions of the present disclosure, and are not limited thereto. Although the present disclosure has been described in detail with reference to the preferred embodiments, those of ordinary skill in the art should understand that the specific implementations of the present disclosure are modified, or some technical features are equivalently replaced without departing from the spirit of the technical solutions of the present disclosure, which should fall within the scope of the technical solutions of the present disclosure.

What is claimed is:

1. An air exhausting device for kitchenware, comprising:

an air duct comprising an air outlet end and a first connecting portion disposed on the air outlet end;

an air outlet member comprising an air inlet end and a second connecting portion provided on the air inlet end, and an air outlet end of the air outlet member being provided with an air outlet port; and wherein the first connecting portion is slidably coupled to the second connecting portion for adjusting a relative position of the air outlet port and the air duct;

a guide assembly arranged between the first connecting portion and the second connecting portion, wherein the guide assembly is configured to guide a relative motion of the air outlet member and the air duct, and the guide assembly is provided on the air outlet member and the first connecting portion;

wherein the air outlet member comprises a first portion and a second portion, the first portion and the second portion are combined to form a housing, one end of the housing has an air inlet port, and an opposite end of the housing has the air outlet port; the first portion and the second portion are connected by a buckle;

an end of the first portion that forms the air outlet port is provided with a first air guide portion, and the first air guide portion is formed by bending of the first portion;

an end of the second portion that forms the air outlet port is provided with a second air guide portion, the second air guide portion is coupled to the first air guide portion, and the second air guide portion is formed by bending of the second portion;

after the first portion is combined with the second portion, the first air guide portion is located on a side of the second air guide portion that forms the air outlet port, and an air exhaust outlet of the air outlet port is formed between the first air guide portion and the second air guide portion;

wherein the air exhausting device for kitchenware further comprises:

a first limiting assembly arranged between the first connecting portion and the second connecting portion for preventing separation of the air outlet member from the air duct; wherein the first limiting assembly comprises:

a first limiting protrusion arranged on one of the first connecting portion and the second connecting portion;

a sliding groove provided on the other one of the first connecting portion and the second connecting portion, wherein the sliding groove extends along a motion direction of the air outlet member relative to the air duct; and a plurality of latching teeth disposed on the sliding groove;

wherein each of the plurality of latching teeth is configured to cooperate with the first limiting protrusion to limit a position of the air outlet member;

wherein an upper side surface of the first limiting protrusion is a surface perpendicular to a side wall of the first connecting portion, and a lower side surface of the first limiting protrusion is an inclined surface at an angle to the side wall of the first connecting portion.

2. The air exhausting device for kitchenware as claimed in claim 1, wherein the first connecting portion and the second connecting portion are sleeved with each other.

3. The air exhausting device for kitchenware as claimed in claim 1, wherein the first limiting assembly comprises:

a limiting surface arranged on the other one of the first connecting portion and the second connecting portion;

wherein the limiting surface cooperates with the first limiting protrusion to prevent separation of the air outlet member from the air duct.

4. The air exhausting device for kitchenware as claimed in claim 3, wherein an end portion of the sliding groove forms the limiting surface.

5. The air exhausting device for kitchenware as claimed in claim 1, wherein the guide assembly comprises:

a guide protrusion arranged on one of the first connecting portion and the second connecting portion; and a guide groove provided on the other one of the first connecting portion and the second connecting portion;

wherein the guide protrusion is slidably coupled to the guide groove.

6. The air exhausting device for kitchenware as claimed in claim 5, wherein the guide protrusion is arranged on the second connecting portion and protrudes toward an inner side of the air outlet member, wherein the guide groove is provided on the first connecting portion.

7. The air exhausting device for kitchenware as claimed in claim 1, wherein the air outlet member comprises an air guide portion formed from the first air guide portion coupled with the second air guide portion, wherein the air outlet port is provided on the air guide portion, and the air guide portion is configured to guide air from the air outlet member to an outside of the kitchenware.

8. A dishwasher, comprising the air exhausting device for kitchenware as claimed in claim 1.

9. The dishwasher as claimed in claim 8, comprising:

a door for opening and closing the dishwasher; and a decorative panel;

wherein the air exhausting device is arranged between the decorative panel and the door, and the air guide portion formed from the first air guide portion coupled with the second air guide portion is located below the decorative panel and extended to an outside of the dishwasher.

10. The dishwasher as claimed in claim 9, comprising: a second limiting assembly arranged between the air outlet member and the decorative panel for limiting a position of the air outlet member.

11. The dishwasher as claimed in claim 10, wherein the second limiting assembly comprises:

a limiting member arranged on one of the decorative panel and the air outlet member; and a second limiting protrusion arranged on the other one of the decorative panel and the air outlet member;

wherein the limiting member is cooperated with the second limiting protrusion to limit the position of the air outlet member.

12. The dishwasher as claimed in claim 11, wherein the limiting member is arranged on the decorative panel, and the limiting member comprises:

a first limiting plate arranged on the decorative panel; and a second limiting plate arranged on the first limiting plate and extended toward the air outlet member;

wherein the second limiting plate is configured to support the second limiting protrusion.

13. The dishwasher as claimed in claim 12, wherein the limiting member comprises a third limiting protrusion arranged on the second limiting plate, wherein a space for accommodating the second limiting protrusion is formed between the third limiting protrusion and the first limiting plate.

14. A kitchenware, comprising a cabinet and the dishwasher as claimed in claim 8, wherein the dishwasher is embedded into the cabinet wholly or partially.

* * * * *